US009777615B2

(12) United States Patent
Matsumoto et al.

(10) Patent No.: US 9,777,615 B2
(45) Date of Patent: Oct. 3, 2017

(54) COOLING DEVICE FOR MULTIPLE CYLINDER ENGINE

(71) Applicant: Mazda Motor Corporation, Aki-gun, Hiroshima (JP)

(72) Inventors: Daisuke Matsumoto, Hiroshima (JP); Daisuke Tabata, Hiroshima (JP); Masahiro Naito, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 69 days.

(21) Appl. No.: 14/769,169

(22) PCT Filed: Feb. 12, 2014

(86) PCT No.: PCT/JP2014/000719
§ 371 (c)(1),
(2) Date: Aug. 20, 2015

(87) PCT Pub. No.: WO2014/129145
PCT Pub. Date: Aug. 28, 2014

(65) Prior Publication Data

US 2015/0377114 A1 Dec. 31, 2015

(30) Foreign Application Priority Data

Feb. 21, 2013 (JP) ..... 2013-031898

(51) Int. Cl.
*F01P 5/10* (2006.01)
*F02F 1/10* (2006.01)
(Continued)

(52) U.S. Cl.
CPC *F01P 3/02* (2013.01); *F01P 3/20* (2013.01); *F01P 5/10* (2013.01); *F02F 1/14* (2013.01);
(Continued)

(58) Field of Classification Search
CPC ..... F01P 2003/021; F01P 2003/024; F01P 2003/027; F01P 2003/028; F02F 1/10; F02F 1/14
(Continued)

(56) References Cited

U.S. PATENT DOCUMENTS 4,549,505 A * 10/1985 Hirano ..... F01P 3/2285 123/41.08
5,113,807 A * 5/1992 Kobayashi ..... B60K 25/06 123/198 C
(Continued)

FOREIGN PATENT DOCUMENTS

JP 201163920 A 7/2010
JP 4845620 B2 10/2011

OTHER PUBLICATIONS

ISA Japanese Patent Office, International Search Report Issued in Application No. PCT/JP2014/000719, May 20, 2014, WIPO, 4 pages.

*Primary Examiner* — Jacob Amick
*Assistant Examiner* — Charles Brauch
(74) *Attorney, Agent, or Firm* — Alleman Hall Creasman & Tuttle LLP

(57) ABSTRACT

The present invention is configured such that: a cylinder block includes an introducing portion provided at a first side of a cylinder row, cooling liquid being introduced through the introducing portion to a water jacket, a restrictor portion provided in a vicinity of the introducing portion and configured to restrict the cooling liquid, introduced through the introducing portion, from flowing to an intake-side portion of the water jacket, and a discharging portion provided at a middle portion of the cylinder row at an intake side, the cooling liquid being discharged from the water jacket through the discharging portion; and an exhaust-side portion of the water jacket is formed such that a passage cross-
(Continued)

sectional area of a cylinder axis direction upper side of the exhaust-side portion is larger than the passage cross-sectional area of a cylinder axis direction lower side of the exhaust-side portion.

11 Claims, 12 Drawing Sheets

(51) Int. Cl.

| | |
|---|---|
| ***F01P 3/02*** | (2006.01) |
| ***F02F 1/14*** | (2006.01) |
| ***F01P 3/20*** | (2006.01) |
| ***F02F 1/40*** | (2006.01) |

(52) U.S. Cl.
CPC ..... *F02F 1/40* (2013.01); *F01P 2003/021* (2013.01); *F01P 2003/024* (2013.01); *F01P 2003/027* (2013.01); *F01P 2003/028* (2013.01); *F01P 2060/00* (2013.01); *F01P 2060/16* (2013.01); *F02F 1/10* (2013.01)

(58) Field of Classification Search
USPC ..... 123/41.44, 41.72
See application file for complete search history.

(56) References Cited

U.S. PATENT DOCUMENTS

| | | | | |
|---|---|---|---|---|
| 7,647,900 | B2 * | 1/2010 | Hayashi | F01P 3/02 123/41.72 |
| 8,474,418 | B2 | 7/2013 | Shikida et al. | |
| 2001/0010262 | A1 * | 8/2001 | Komoda | F28D 9/0043 165/167 |
| 2005/0279295 | A1 * | 12/2005 | Vialard | F01P 7/14 123/41.74 |
| 2010/0242868 | A1 * | 9/2010 | Shikida | F01P 3/02 123/41.79 |
| 2011/0259306 | A1 * | 10/2011 | Winsor | F02B 29/0412 123/568.12 |

* cited by examiner

COOLING DEVICE FOR MULTIPLE CYLINDER ENGINE

TECHNICAL FIELD

The present invention relates to a cooling device for a multiple cylinder engine of a car or the like, and particularly belongs to a technical field of an engine in which a cylinder head and a cylinder block are cooled down by a cooling liquid.

BACKGROUND ART

To improve fuel efficiency and exhaust emission control performance, cars and the like conventionally adopt a technology for quickly warming up an engine when the engine is cold.

For example, PTL 1 discloses a technology for quickly completing the warm-up in such a manner that: when the engine is cold, the flow of a cooling liquid to a cylinder block is blocked, but a small amount of cooling liquid is supplied to a cylinder head from one end of a cylinder row toward the other end of the cylinder row; as the temperature of the cooling liquid increases, the cooling liquid is supplied to the cylinder block from one the end of the cylinder row to the other end of the cylinder row; and the flow rate of the cooling liquid circulating toward the cylinder head is increased.

When the engine is actually operating, the temperature of a cylinder head side of the cylinder block becomes higher than the temperature of an opposite side of the cylinder block due to exhaust gas, and the temperature of an exhaust side of the cylinder block becomes higher than the temperature of an intake side of the cylinder block due to the exhaust gas. Thus, a temperature difference between an upper side and lower side of each cylinder tends to be generated, and a temperature difference between the intake side and exhaust side of each cylinder tends to be generated. When the cooling liquid is supplied from one end of the cylinder row of the cylinder block to the other end of the cylinder row, and as the cooling liquid flows from an upstream side of a passage toward a downstream side of the passage, the temperature of the cooling liquid increases. Therefore, the temperature of the cylinder at the one end becomes higher than the temperature of the cylinder at the other end. Thus, a temperature difference among the cylinders tends to be generated.

When temperature distribution in each cylinder becomes non-uniform due to the temperature difference between the upper side and lower side of each cylinder and the temperature difference between the intake side and exhaust side of each cylinder, roundness of each cylinder bore deteriorates due to heat deformation. Therefore, sliding resistance at the cylinder bore due to sliding of a piston ring increases, and this deteriorates the fuel efficiency of the engine. Further, the following problems may occur. Specifically, a large amount of air-fuel mixture may leak into a crank case and the like through an expanded gap between the piston and the cylinder, and this may accelerate the deterioration of engine oil and the corrosion of metal. In addition, lubricating oil may flow into a combustion chamber, and this may cause an increase in oil consumption.

Due to the temperature difference among the cylinders, thermal distortion of the entire engine occurs. With this, the roundness of each cylinder bore deteriorates as described above, or uniformity of intake air filling by an intake system deteriorates. Thus, the fuel efficiency may deteriorate.

When these temperature differences further increase in the case of a cylinder block made of an aluminum alloy, there is a concern that a material strength of a portion whose temperature exceeds 200° C. deteriorates. In addition, knocking may occur in a high-temperature region of the cylinder. Therefore, it is desirable that the temperature difference in each cylinder and the temperature difference among the cylinders be as small as possible.

However, this conventional art only discloses that, regarding cooling of the cylinder block, the cooling liquid is supplied from one end of the cylinder row of a water jacket to the other end of the cylinder row. Therefore, there is a problem that the temperature difference between the upper side and lower side of each cylinder, the temperature difference between the exhaust side and intake side of each cylinder, and the temperature difference among the cylinders cannot be adequately suppressed.

PTL 2 discloses a technology for suppressing the temperature difference between the upper side and lower side of the cylinder in such a manner that: a spacer is arranged in the water jacket of the cylinder block; the cooling liquid is supplied to an upper passage and a lower passage, the flow rate and flow velocity of the cooling liquid in the upper passage of the water jacket is increased; and the cooling liquid flows from one end of the cylinder row to the other end of the cylinder row and then makes a U-turn to the one side.

However, according to this conventional art, since the temperature difference between the exhaust side and intake side of each cylinder and the temperature difference among the cylinders cannot be adequately suppressed, a problem is that the temperature distribution of all the cylinders becomes non-uniform.

CITATION LIST

Patent Literature

PTL 1: Japanese Laid-Open Patent Application Publication No. 2010-163920

PTL 2: Japanese Patent No. 4845620

SUMMARY OF INVENTION

Technical Problem

An object of the present invention is to uniformize temperature distribution of all cylinders of a cylinder block of a multiple cylinder engine by suppressing a temperature difference between an upper side and lower side of each cylinder, a temperature difference between an exhaust side and intake side of each cylinder, and a temperature difference among the cylinders.

Solution to Problem

To achieve the above object, a cooling device for a multiple cylinder engine according to the present invention is configured as below.

First, an invention according to the present application is a cooling device for a multiple cylinder engine, the cooling device comprising: a water jacket provided at a cylinder block so as to surround cylinder bores of a plurality of cylinders arranged in series; a water jacket provided at a cylinder head; and a cooling liquid passage in which a cooling liquid circulates by a water pump, the cooling liquid passage extending through these water jackets and a radiator, wherein: the cylinder block includes an introducing portion provided at a first side of a cylinder row, the cooling liquid being introduced through the introducing portion to the water jacket of the cylinder block, a restrictor portion provided in a vicinity of the introducing portion and configured to restrict the cooling liquid, introduced through the introducing portion, from flowing to an intake-side portion of the water jacket of the cylinder block, and a discharging portion provided at a middle portion of the cylinder row at an intake side, the cooling liquid being discharged from the water jacket of the cylinder block through the discharging portion; and an exhaust-side portion of the water jacket of the cylinder block is formed such that a passage cross-sectional area of a cylinder axis direction upper side of the exhaust-side portion is larger than a passage cross-sectional area of a cylinder axis direction lower side of the exhaust-side portion.

The above cooling device may be configured such that: a spacer is provided inside the water jacket of the cylinder block so as to be spaced apart from an inner wall portion and an outer wall portion of the water jacket of the cylinder block; the restrictor portion is formed at an outer periphery of the spacer; and an exhaust-side portion of the spacer is formed such that a space between the spacer and the outer wall portion at a cylinder axis direction upper side of the exhaust-side portion is larger than a space between the spacer and the outer wall portion at a cylinder axis direction lower side of the exhaust-side portion.

Typically, a water jacket of a cylinder block is configured as a concave groove annularly formed on an upper surface of the cylinder block. Among wall surfaces forming this concave groove, a side wall at an outer side is referred to as an outer wall portion, and a side wall at an inner side is referred to as an inner wall portion.

The above cooling device may be configured such that: the cylinder head includes a discharging portion provided at a second side of the cylinder row, the cooling liquid being discharged from the water jacket of the cylinder head through the discharging portion; the water jacket of the cylinder block and the water jacket of the cylinder head are connected to each other through a communication passage; and the cooling liquid passage includes a first passage bypassing the radiator and coupling the discharging portion of the cylinder head to the introducing portion, a second passage bypassing the radiator and coupling the discharging portion of the cylinder head to the introducing portion through a first control valve configured to control a flow rate of the cooling liquid, a third passage bypassing the radiator and coupling the discharging portion of the cylinder block to the introducing portion through a second control valve configured to control the flow rate of the cooling liquid, and a fourth passage coupling the discharging portion of the cylinder head to the introducing portion through the radiator and a third control valve configured to control the flow rate of the cooling liquid, the cooling device further including a cooling circuit control portion configured to close the first to third control valves during warm up and sequentially open the first to third control valves as a temperature of the engine increases.

The above cooling device may be configured such that the second passage extends through at least one of an air conditioner heater core and an exhaust gas recirculation (EGR) cooler.

The above cooling device may be configured such that the third passage extends through at least one of an engine oil cooler and an oil heat exchanger of an automatic transmission.

Advantageous Effects of Invention

The invention according to the present application can obtain the following effects by the above configuration.

According to the above cooling device, the passage cross-sectional area of the cylinder axis direction upper side (cylinder head side) of the exhaust-side portion of the water jacket of the cylinder block is larger than the passage cross-sectional area of the cylinder axis direction lower side of the exhaust-side portion of the water jacket of the cylinder block. Therefore, an exhaust side upper portion of the cylinder block can be cooled down more than an exhaust side lower portion of the cylinder block, the exhaust side upper portion being a portion which especially tends to increase in temperature due to the exhaust gas when the engine is actually operating. On this account, the temperature difference between the upper side and lower side of each cylinder can be suppressed.

With the restrictor portion provided in the vicinity of the introducing portion, the cooling liquid introduced from the introducing portion is restricted from flowing to the intake-side portion of the water jacket of the cylinder block. Therefore, by supplying a larger amount of cooling water to the exhaust-side portion, the cylinder block at the exhaust side which tends to become higher in temperature than the intake side can be cooled down. Thus, the temperature difference between the intake side and exhaust side of each cylinder can be suppressed.

Further, the introducing portion through which the cooling liquid is introduced to the water jacket of the cylinder block is provided at the first side of the cylinder row. The restrictor portion, which restricts the cooling liquid introduced through the introducing portion from flowing to the intake-side portion of the water jacket of the cylinder block, is provided in the vicinity of the introducing portion. The discharging portion through which the cooling liquid is discharged from the water jacket of the cylinder block is provided at the middle portion of the cylinder row at the intake side. Therefore, the cooling liquid introduced through the first side of the cylinder row flows from the exhaust side through the second side of the cylinder row to the intake side and is then discharged through the middle portion of the cylinder row at the intake side.

As the cooling liquid absorbs the heat of the cylinders, the temperature of the cooling liquid gradually increases. Therefore, the exhaust side of the cylinder at the first side of the cylinder row is cooled down by the cooling liquid which is relatively low in temperature, and the intake side of the cylinder at the first side of the cylinder row is not cooled down since the cooling liquid hardly flows to the intake side due to the restrictor portion. However, the exhaust side and intake side of the cylinder at the second side of the cylinder row are cooled down by the cooling liquid which is relatively high in temperature. Therefore, in the case of comparing an average of the degree of cooling of the exhaust side of one cylinder and the degree of cooling of the intake side of the one cylinder with an average of the degree of cooling of the exhaust side of a different cylinder and the degree of cooling of the intake side of the different cylinder, the cylinder at the first side of the cylinder row and the cylinder at the second side of the cylinder row are substantially equally cooled down. On this account, the temperature difference among the cylinders is suppressed.

As above, the cooling device can uniformize the temperature distribution of all the cylinders by suppressing the temperature difference between the upper side and lower side of each cylinder, the temperature difference between the exhaust side and intake side of each cylinder, and the temperature difference among the cylinders.

According to the above cooling device, the spacer is provided inside the water jacket of the cylinder block so as to be spaced apart from the inner wall portion and outer wall portion of the water jacket of the cylinder block. Therefore, it is possible to prevent a case where the cylinder is directly cooled down by the cooling liquid introduced through the introducing portion and becomes low in temperature locally.

The exhaust-side portion of the spacer is formed such that the space between the spacer and the outer wall portion at the cylinder axis direction upper side of the exhaust-side portion is larger than the space between the spacer and the outer wall portion at the cylinder axis direction lower side of the exhaust-side portion. Therefore, the above-described effect of reducing the temperature difference between the upper side and lower side of each cylinder can be realized by the above configuration.

Further, since the restrictor portion is provided at the outer periphery of the spacer, the restrictor portion can be easily integrated with the spacer.

According to the above cooling device, the cylinder head includes the discharging portion provided at the second side of the cylinder row, the cooling liquid being discharged from the water jacket of the cylinder head through the discharging portion, and the water jacket of the cylinder block and the water jacket of the cylinder head are connected to each other through the communication passage. Therefore, when the cooling circuit control portion closes the first to third control valves during the warm up, the cooling liquid circulates only in the first passage coupling the head-side discharging portion and the introducing portion to each other. At this time, the cooling liquid hardly flows to the water jacket of the cylinder block. Therefore, the temperature of the cylinder block gradually increases. On this account, the warm up of the engine can be accelerated.

The cooling circuit control portion sequentially opens the first to third control valves as the temperature of the engine increases. At this time, when the first control valve is opened, the cooling liquid circulates also in the second passage. However, since the second passage does not extend through the radiator or the cylinder block, the warm up of the engine is continuously accelerated. Next, when the second control valve is opened, the cooling liquid circulates also in the third passage. Since the third passage is connected to the cylinder block, the cylinder block is also cooled down to some extent. However, since the third passage bypasses the radiator, the warm up of the engine progresses. Further, when the third control valve is opened, the cooling liquid circulates also in the fourth passage. Since the fourth passage is connected to the radiator, the temperature of the cooling liquid is decreased by the radiator. Thus, the engine can be maintained at a predetermined temperature after the warm up. Therefore, the cylinders and the cylinder head can be properly cooled down in accordance with the temperature of the engine.

According to the above cooling device, the first control valve is opened in the middle of the warm up, and the cooling liquid circulates also in the second passage extending through the air conditioner heater core or the EGR cooler. Therefore, a heating performance can be secured from the middle of the warm up, and the EGR cooler can be properly cooled down.

According to the above cooling device, the third control valve is opened in the middle of the warm up, and the cooling liquid circulates also in the third passage extending through the engine oil cooler or the oil heat exchanger of the automatic transmission. Therefore, engine oil can be cooled down. In addition, transmission oil is properly heated so that the sliding resistance is quickly decreased by quickly decreasing the viscosity of the transmission oil. Thus, the fuel efficiency can be improved.

DESCRIPTION OF EMBODIMENTS

Hereinafter, an embodiment of a cooling device for a multiple cylinder engine according to the present invention will be explained in reference to FIGS. 1 to 15.

Figure 1:
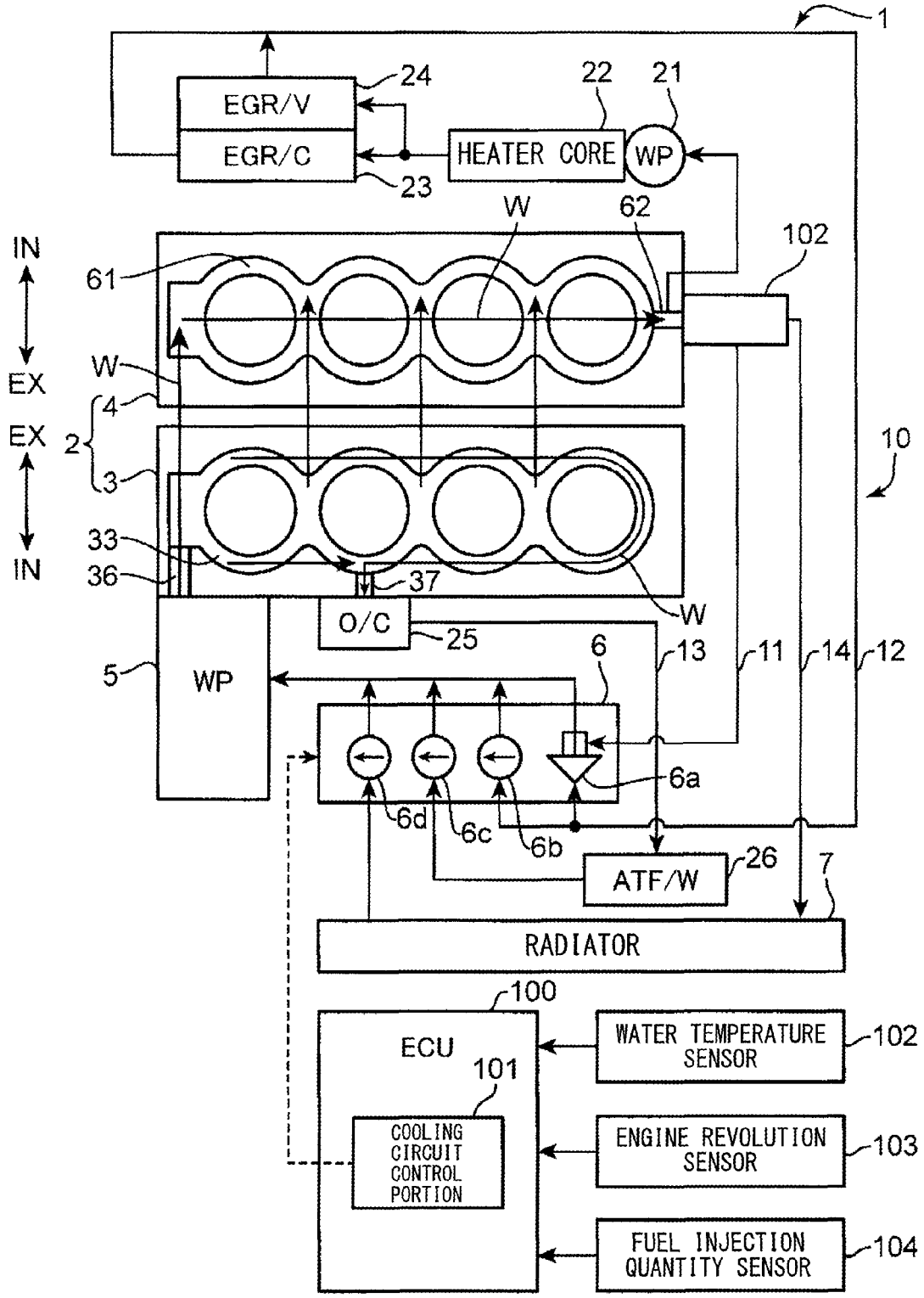
FIG. 1 is a block diagram showing a schematic configuration of a cooling device of one embodiment of the present invention.

FIG. 1 shows a schematic configuration of a cooling device 1 for the multiple cylinder engine according to the embodiment of the present invention. A multiple cylinder engine 2 (hereinafter simply referred to as an "engine") is a so-called cross-flow type in-line four-cylinder diesel engine in which: four cylinders are arranged in series in a crank shaft direction; and an intake system and an exhaust system are arranged at respective opposing sides of a cylinder head 4. The engine 2 is mounted in an engine room (not shown) provided at a vehicle front portion such that: a cylinder row extends in a vehicle width direction; the exhaust system is located at a rear side in a vehicle front/rear direction; and a cylinder axis of each cylinder extends in an upper/lower direction.

The engine 2 is mainly constituted by a cylinder block 3 and the cylinder head 4 provided at an upper side of the cylinder block 3.

FIG. 1 shows the cylinder block 3 when viewed from above and shows the cylinder head 4 when viewed from below. Therefore, a positional relation between the intake side (shown by "IN") and exhaust side (shown by "EX") of the cylinder block 3 and a positional relation between the intake side (shown by "IN") and exhaust side (shown by "EX") of the cylinder head 4 are opposite to each other.

The cylinder block 3 is provided with a block-side water jacket 33, an introducing hole 36, and a block-side discharging hole 37 described below. The cylinder head 4 is provided with a head-side water jacket 61 and a head-side discharging hole 62 described below. Cooling water W introduced through the introducing hole 36 into the block-side water jacket 33 is discharged through the block-side discharging hole 37, and the cooling water W introduced through the introducing hole 36 into the head-side water jacket 61 is discharged through the head-side discharging hole 62.

A water pump 5 is provided at the introducing hole 36. The water pump 5 supplies the cooling water W into the water jackets 33 and 61. The water pump 5 is a pump passively driven by rotation of the engine 2.

The cooling device 1 includes a cooling liquid passage through which the cooling water W circulates in the water jackets 33 and 61 suitably through a radiator 7 and/or the like. The cooling liquid passage is constituted by first to fourth passages 11 to 14. Switching of the first to fourth passages 11 to 14 for circulating the cooling water W in any one of the first to fourth passages 11 to 14 is performed in such a manner that a cooling circuit control portion 101 controls a cooling circuit switching portion 6 constituted by a thermostat valve 6*a* and first to third control valves 6*b* to 6*d*. Next, the first to fourth passages 11 to 14 will be explained in detail.

As shown in FIG. 1, the first passage 11 couples the head-side discharging hole 62 and the introducing hole 36 to each other. The first passage 11 bypasses the radiator 7 and extends through a water temperature sensor 102 and the thermostat valve 6*a* in that order. The water temperature sensor 102 measures the temperature of the cooling water W. The thermostat valve 6*a* is a valve which opens when the control valves 6*b* to 6*d* break down, and the temperature of the cooling water W becomes not less than a predetermined value. According to the thermostat valve 6*a*, in a normal state, the cooling water W circulates only in the first passage 11. In an abnormal state, the cooling water W circulates also in the second passage 12 described below. Thus, the engine 2 can be protected. The water temperature sensor 102 is provided in the vicinity of the head-side discharging hole 62.

The second passage 12 couples the head-side discharging hole 62 and the introducing hole 36 to each other. The second passage 12 bypasses the radiator 7 and extends through an idling stop water pump 21, an air conditioner heater core 22, an EGR cooler 23 (or an EGR valve 24), and a first control valve 6*b* in that order. The idling stop water pump 21 is a pump which supplies the cooling water W to the air conditioner heater core 22 when the engine 2 is temporarily stopped during idling. The second passage 12 extends through the EGR cooler 23 and the EGR valve 24 in parallel.

The third passage 13 couples the discharging hole 37 and the introducing hole 36 to each other. The third passage 13 bypasses the radiator 7 and extends through an engine oil cooler 25, an oil heat exchanger 26 of an automatic transmission, and a second control valve 6*c* in that order. The engine oil cooler 25 is provided at the block-side discharging hole 37.

The fourth passage 14 couples the head-side discharging hole 62 and the introducing hole 36 to each other. The fourth passage 14 extends through the water temperature sensor 102, the radiator 7, and the third control valve 6*d* in that order.

The cooling circuit control portion 101 is one of control portions provided in an ECU 100. The cooling circuit control portion 101 estimates a head combustion chamber wall surface temperature T of the engine 2 based on: the water temperature sensor 102 which detects the temperature of the cooling water W; an engine revolution sensor 103; a fuel injection quantity sensor 104; and a load state of the engine 2 which is determined by an engine revolution and a fuel injection quantity. The cooling circuit control portion 101 controls the first to third control valves 6*b* to 6*d* in accordance with the estimated head combustion chamber wall surface temperature T.

Figure 2:
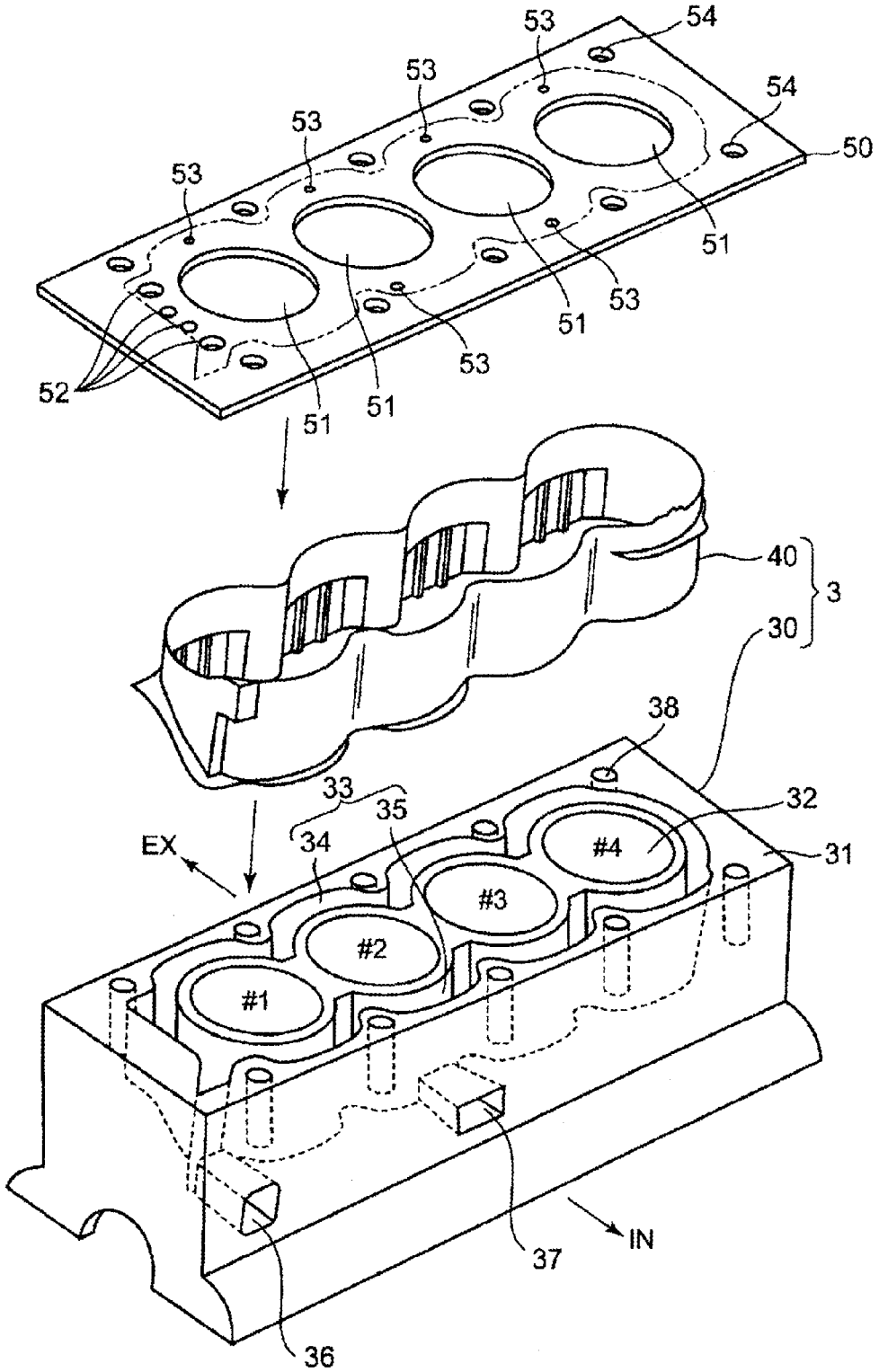
FIG. 2 is an exploded perspective view of a cylinder block of the cooling device.
Figure 3:
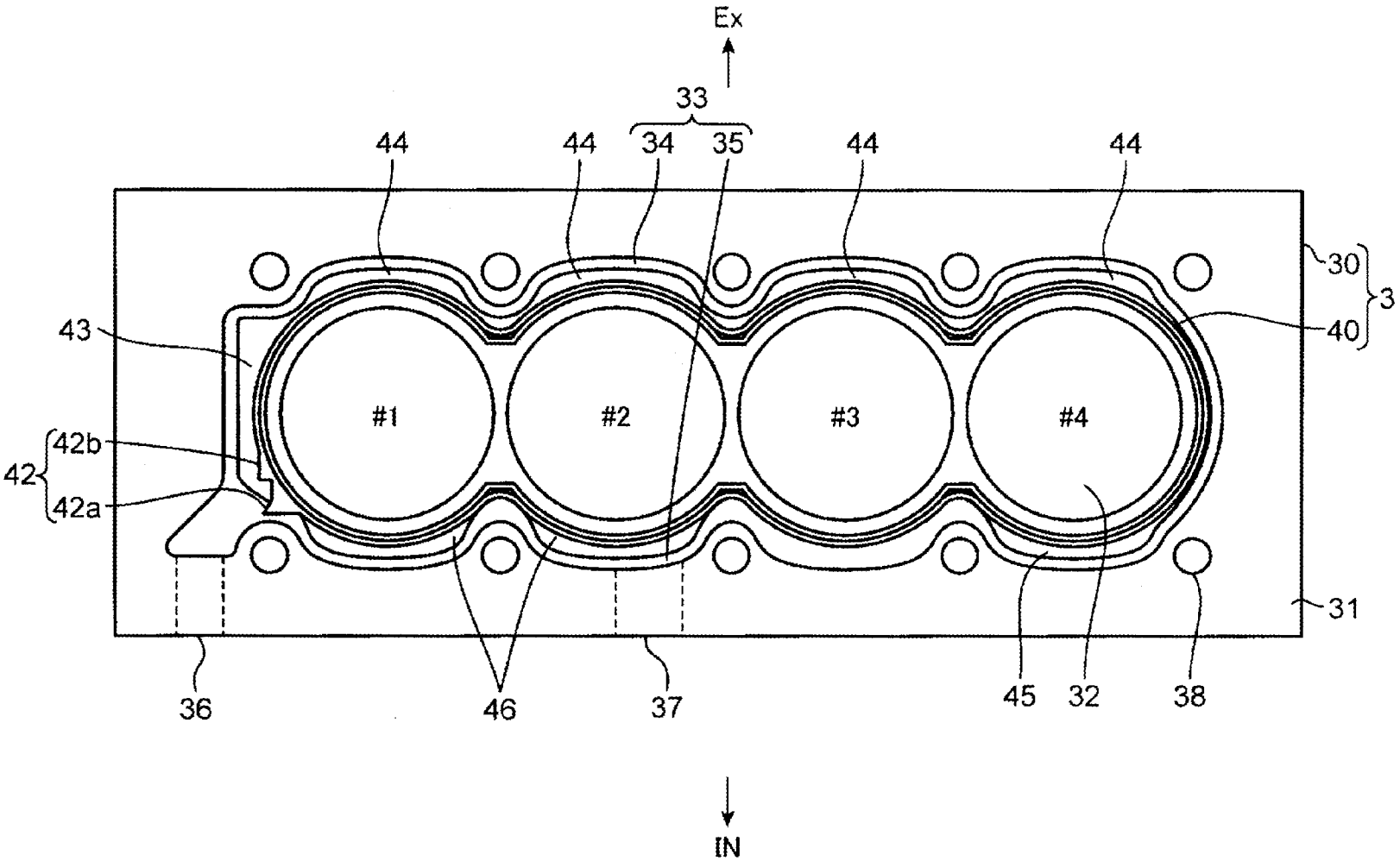
FIG. 3 is a plan view of the cylinder block.

FIGS. 2 and 3 are an exploded perspective view of the cylinder block 3 and a plan view of the cylinder block 3, respectively. The cylinder block 3 is mainly constituted by a cylinder block main body 30 and a spacer 40. Although a gasket 50 is not a component of the cylinder block 3, the gasket 50 is shown in FIG. 2 for convenience of explanation.

The cylinder block main body 30 is provided such that cylinder axes of cylinder bores 32 of first to fourth cylinders #1 to #4 arranged in series extend in the upper/lower direction. As shown in FIGS. 2 and 3, the block-side water jacket 33 is formed on an upper surface 31 of the cylinder block main body 30. The block-side water jacket 33 is an annular concave groove surrounding these four cylinder bores 32. The block-side water jacket 33 is constituted by an exhaust-side passage 34 and an intake-side passage 35. The exhaust-side passage 34 extends through the exhaust side of the cylinder block 3. The intake-side passage 35 extends through the intake side of the cylinder block 3.

In the explanation of the present embodiment, the first to fourth cylinders #1 to #4 are lined up in this order from left to right when viewed from the intake side of the cylinder block 3. Regarding the cylinder row in which the cylinders #1 to #4 are lined up, a side where the first cylinder #1 is provided is referred to as a "first side", and a side where the fourth cylinder is provided is referred to as a "second side".

Regarding wall surfaces forming the exhaust-side passage 34 and intake-side passage 35 of the block-side water jacket 33 that is the concave groove, an inner side wall of the exhaust-side passage 34 and an inner side wall of the intake-side passage 35 are referred to as inner wall portions 34*a* and 35*a*, respectively, and an outer side wall of the exhaust-side passage 34 and an outer side wall of the intake-side passage 35 are referred to as outer wall portions 34*b* and 35*b*, respectively.

The cylinder block main body 30 is provided with the introducing hole 36 and the discharging hole 37. The introducing hole 36 is provided at the first side of the cylinder row and introduces the cooling water W to the block-side water jacket 33. The discharging hole 37 is provided at the intake side and at a middle portion of the cylinder row and discharges the cooling water W from the block-side water jacket 33.

Further, the cylinder block main body 30 is provided with screw holes 38. A plurality of head bolts can be threadedly engaged with the screw holes 38 such that the cylinder block 3 and the cylinder head 4 are coupled to each other via the gasket 50.

The gasket 50 is a metal sheet gasket formed in such a manner that: a plurality of metal plates are stacked on one another; and the metal plates are integrated with one another by caulking the metal plates at plural positions. The entire shape of the gasket 50 corresponds to the shape of the upper surface 31 of the cylinder block main body 30.

As shown in FIG. 2, the gasket 50 is provided with circular holes 51 and through holes 54. The circular holes 51 are formed at respective positions corresponding to the cylinder bores 32 of the cylinder block main body 30. The through holes 54 are formed at respective positions corresponding to the screw holes 38, and the above-described head bolts penetrate through the through holes 54.

Further, the gasket 50 is provided with a plurality of first communication holes 52 and a plurality of second communication holes 53. The block-side water jacket 33 and the head-side water jacket 61 communicate with each other through the first communication holes 52 and the second communication holes 53. The first communication holes 52 are provided at the first side of the cylinder row, and the second communication holes 53 are provided at the exhaust side and the intake side.

When the cylinder block 3 and the cylinder head 4 are coupled to each other, peripheries of the circular holes 51 and peripheries of the through holes 54 are sealed by the elastic repulsive force of the gasket 50. Thus, leakage of a combustion gas from combustion chambers of the cylinders #1 to #4, leakage of the cooling water W from the water jackets 33 and 61, and the like can be prevented.

The cylinder head 4 is provided with the head-side discharging hole 62. The head-side discharging hole 62 is provided at the second side of the cylinder row and discharges the cooling water W from the head-side water jacket 61.

Figure 4:
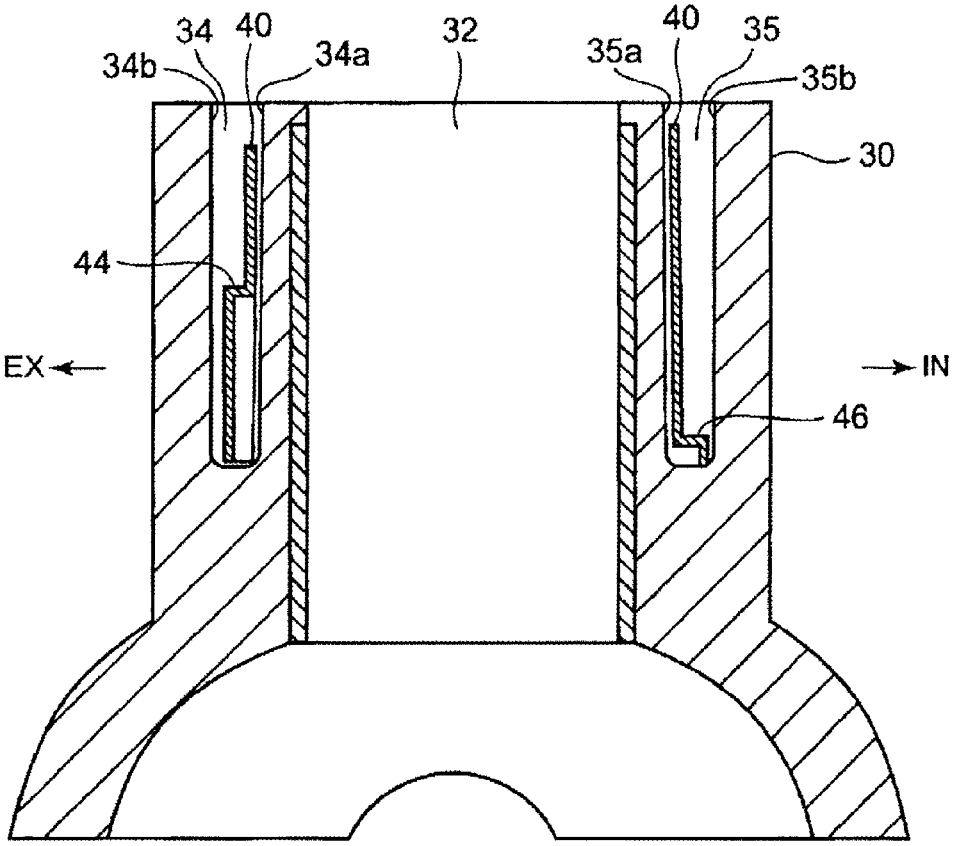
FIG. 4 is a vertical cross-sectional view of a second cylinder of the cylinder block.
Figure 5:
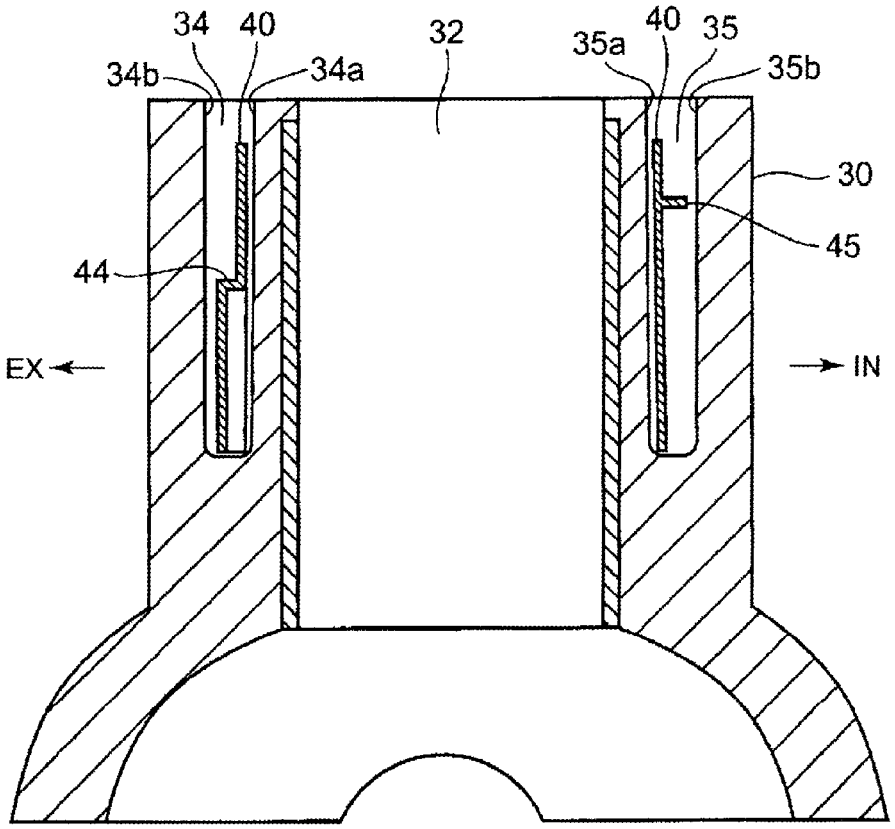
FIG. 5 is a vertical cross-sectional view of a fourth cylinder of the cylinder block.

FIGS. 4 and 5 are a vertical cross-sectional view of the second cylinder #2 of the cylinder block 3 and a vertical cross-sectional view of the fourth cylinder #4 of the cylinder block 3, respectively.

As shown in FIGS. 4 and 5, the spacer 40 is provided inside the block-side water jacket 33 such that a bottom portion of the spacer 40 contacts a bottom surface of the block-side water jacket 33. In addition, the spacer 40 is provided so as to be spaced apart from the inner wall portions 34*a* and 35*a* and outer wall portions 34*b* and 35*b* of the block-side water jacket 33.

A space between an inner peripheral surface of the spacer 40 and the inner wall portion 34*a* of the block-side water jacket 33 and a space between the inner peripheral surface of the spacer 40 and the inner wall portion 35*a* of the block-side water jacket 33 are relatively small, and a space between an outer peripheral surface of the spacer 40 and the outer wall portion 34*b* of the block-side water jacket 33 and a space between the outer peripheral surface of the spacer 40 and the outer wall portion 35*b* of the block-side water jacket 33 are relatively large. The space outside the spacer 40 is a passage through which the cooling water W mainly flows. It should be noted that each of "the exhaust-side passage 34" and "the intake-side passage 35" denotes the space outside the spacer 40.

As shown in a left side in FIG. 4 and a left side in FIG. 5, the space between the spacer 40 and the outer wall portion 34*b* at an upper side of a below-described step portion 44 of the spacer 40 is larger than the space between the spacer 40 and the outer wall portion 34*b* at a lower side of the step portion 44 of the spacer 40. Therefore, a passage cross-sectional area of a cylinder axis direction upper side of the exhaust-side passage 34 is larger than the passage cross-sectional area of a cylinder axis direction lower side of the exhaust-side passage 34.

Figure 7:
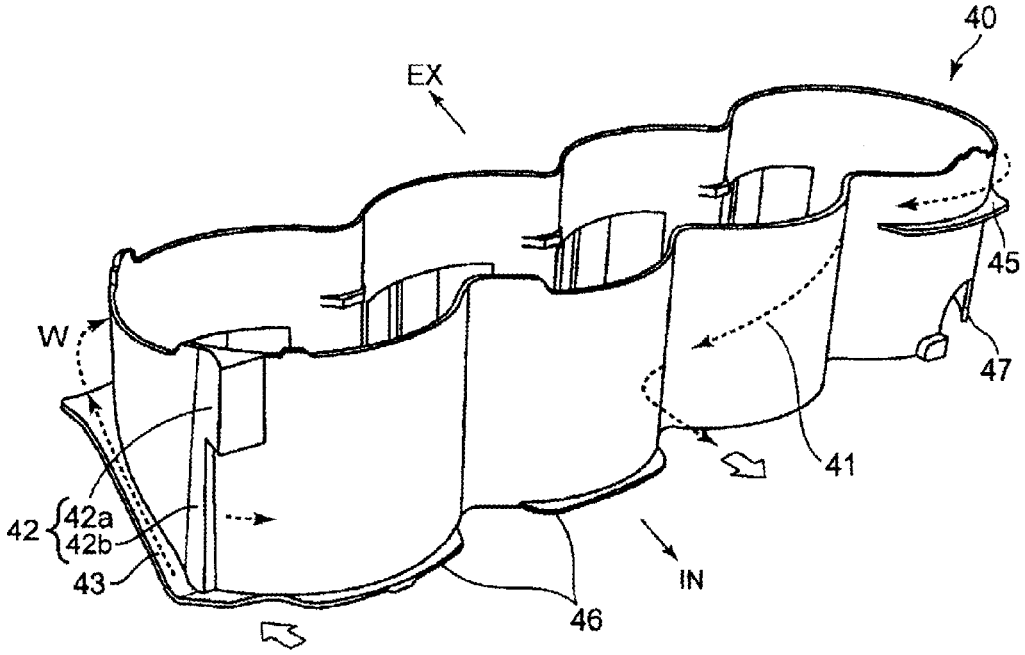
FIG. 7 is a perspective view of an intake side of a spacer.
Figure 8:
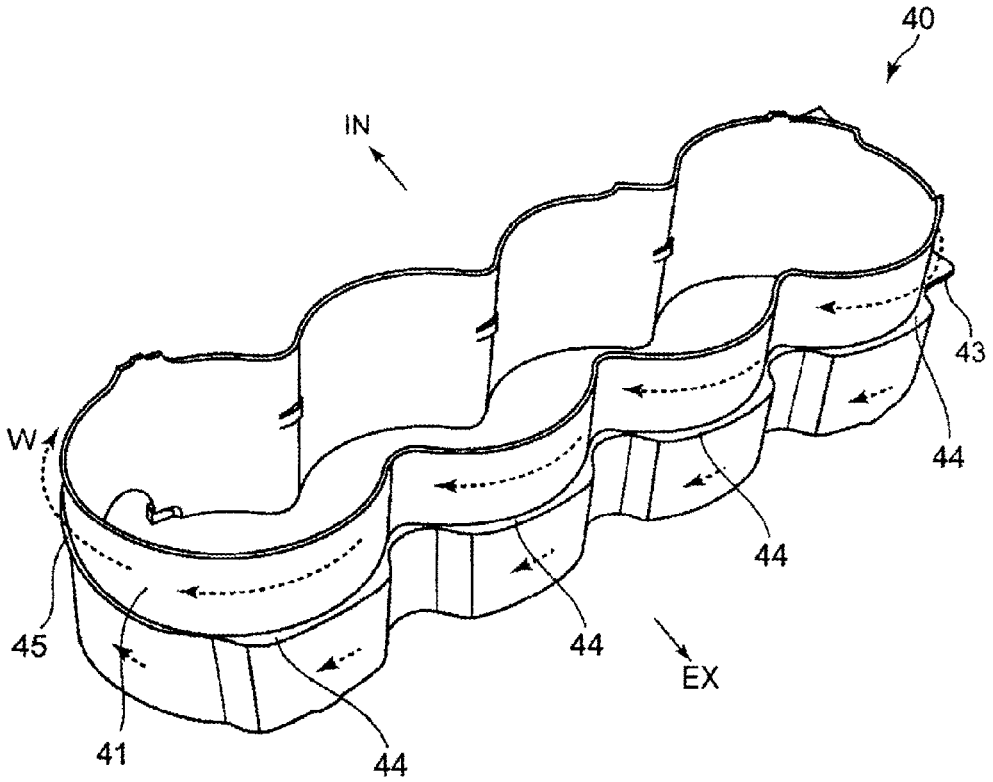
FIG. 8 is a perspective view of an exhaust side of the spacer.
Figure 9:
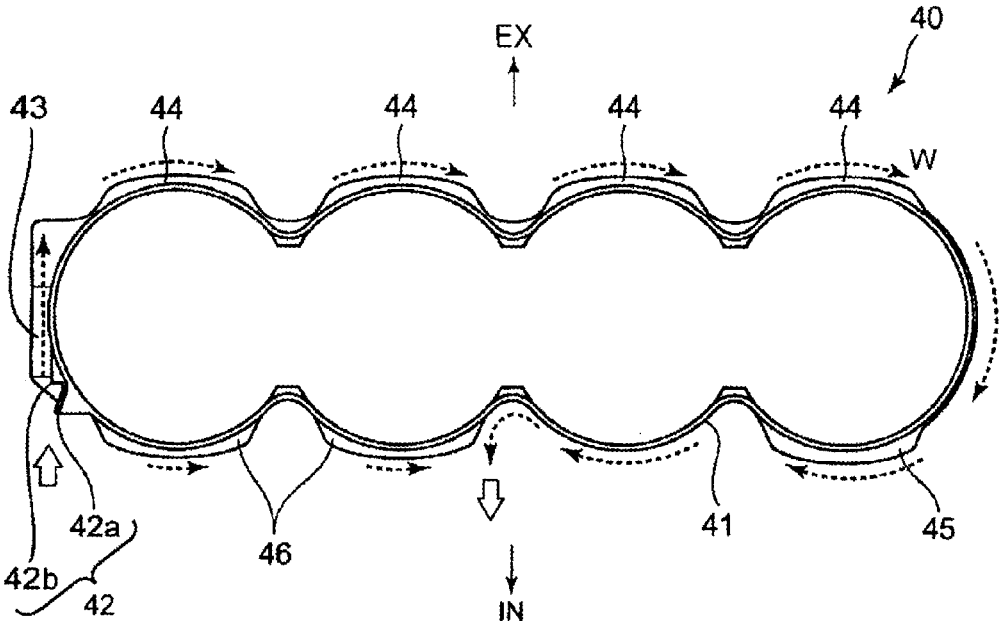
FIG. 9 is a plan view of the spacer.
Figure 10:
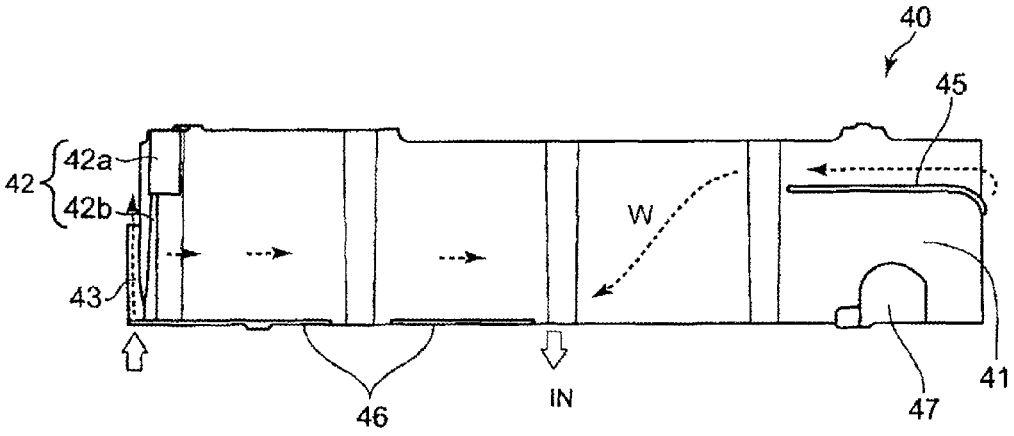
FIG. 10 is a front view of the exhaust side of the spacer.
Figure 11:
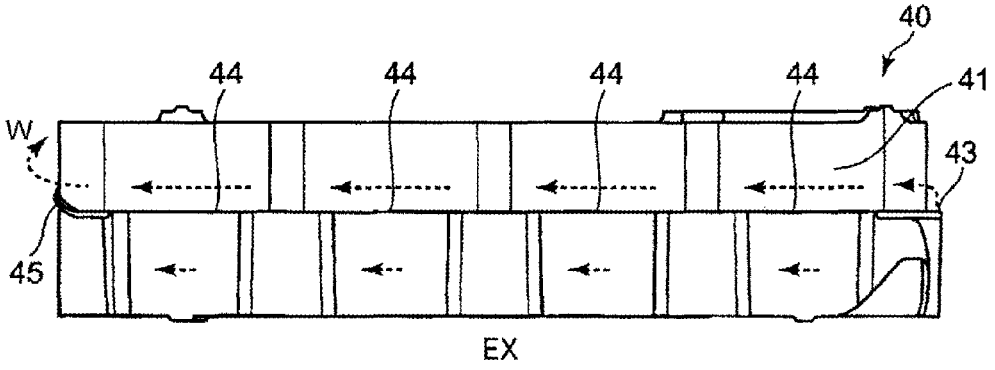
FIG. 11 is a rear view of the intake side of the spacer.
Figure 12:
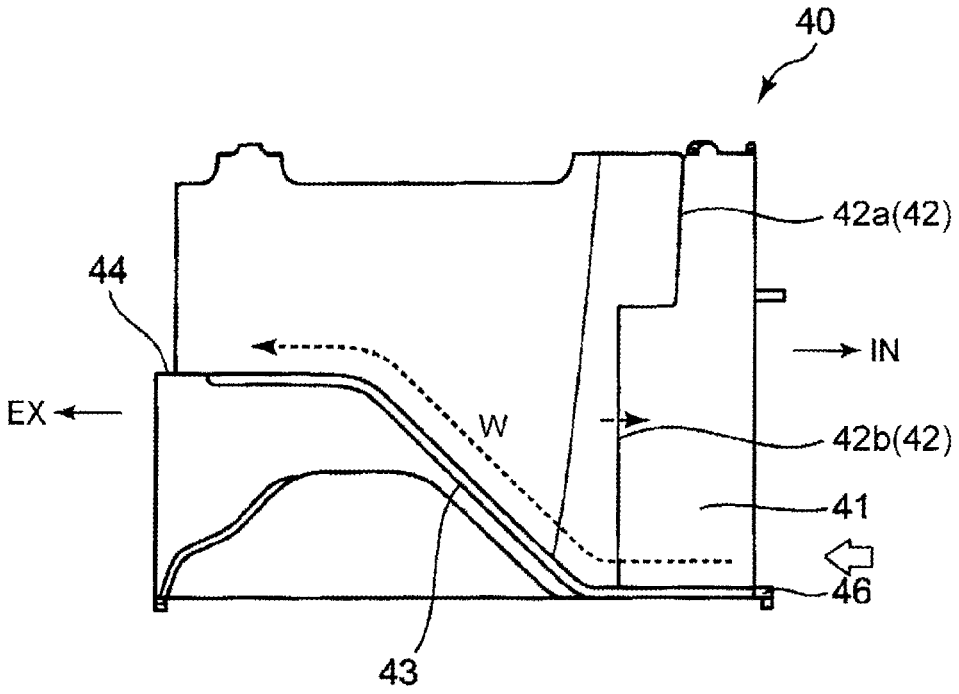
FIG. 12 is a side view of an inclined portion side of the spacer.
Figure 13:
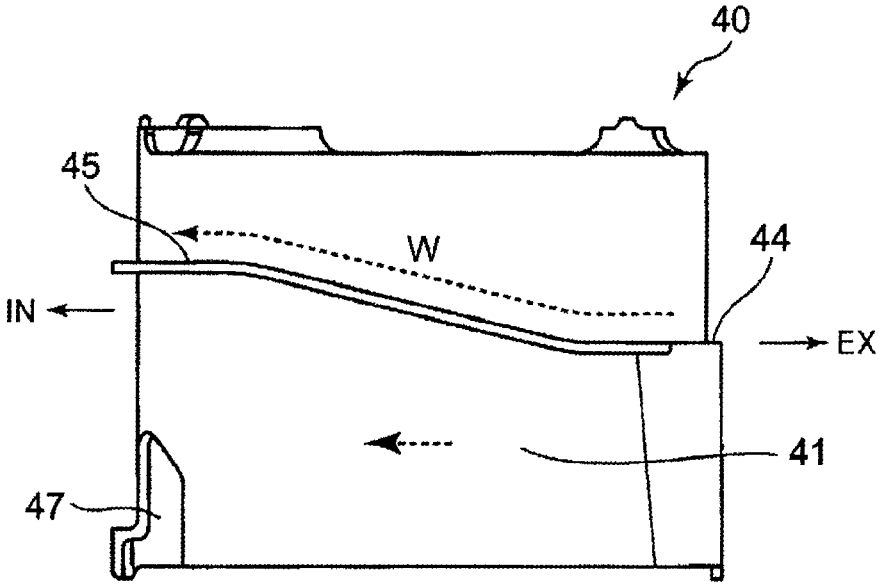
FIG. 13 is a side view of a guide portion side of the spacer.

The structure of the spacer 40 will be explained in reference to FIGS. 7 to 13. FIGS. 7 and 8 are a perspective view of the spacer 40 when viewed from the intake side and a perspective view of the spacer 40 when viewed from the exhaust side, respectively. FIG. 9 is a plan view of the spacer 40 when viewed from above. FIGS. 10 and 11 are a front view of the spacer 40 when viewed from the exhaust side and a rear view of the spacer 40 when viewed from the intake side, respectively. FIGS. 12 and 13 are a side view of the spacer 40 when viewed from an introducing portion side and a side view of the spacer 40 when viewed from a side opposite to the introducing portion side. Each of these drawings shows reference characters IN (intake side) and EX (exhaust side) which show directions when the spacer 40 is provided inside the block-side water jacket 33.

The spacer 40 is mainly constituted by a vertical wall portion 41. The vertical wall portion 41 has such a thickness that the vertical wall portion 41 is accommodated inside the block-side water jacket 33 so as to be spaced apart from the block-side water jacket 33 and has such a height that the vertical wall portion 41 does not project from the upper surface 31 of the cylinder block 3. Further, the vertical wall portion 41 extends substantially in parallel with the cylinder axis direction and has an annular shape in a plan view.

For example, as shown in FIGS. 7, 9, and 12, a restrictor portion 42 is provided at the vertical wall portion 41 so as to be located at the first side and the intake side. The restrictor portion 42 projects outward from an outer periphery of the vertical wall portion 41 and has a rib shape. The restrictor portion 42 is constituted by an upper restrictor portion 42*a* and a lower restrictor portion 42*b*. A projection amount of the upper restrictor portion 42*a* is larger than the projection amount of the lower restrictor portion 42*b*.

For example, as shown in FIGS. 7 and 12, an inclined portion 43 is provided at the vertical wall portion 41 so as to be located at the first side. The inclined portion 43 is smoothly inclined so as to go up from the intake side toward the exhaust side and from a lower end of the vertical wall portion 41 to a cylinder axis direction middle portion of the vertical wall portion 41. The inclined portion 43 has a rib shape.

For example, as shown in FIGS. 8 and 11 to 13, a step portion 44 is formed at the cylinder axis direction middle portion of the vertical wall portion 41 at the exhaust side. The step portion 44 is continuous with an upper end portion of the inclined portion 43. With this, when the spacer 40 is provided inside the block-side water jacket 33, the space between the spacer 40 and the outer wall portion 34*b* at an upper side of the step portion 44 becomes larger than the space between the spacer 40 and the outer wall portion 34*b* at a lower side of the step portion 44.

For example, a guide portion 45 may be provided as shown in FIGS. 7, 10, and 13. The guide portion 45 is provided at the vertical wall portion 41 at the second side so as to extend from the exhaust side to the intake side. The guide portion 45 is continuous with the step portion 44. The guide portion 45 is smoothly inclined from the exhaust side toward the intake side so as to go further up to the cylinder head side. The guide portion 45 has a rib shape.

Further, for example, a flange portion 46 may be formed as shown in FIGS. 7 and 12. The flange portion 46 is formed at a lower end of the vertical wall portion 41 at the intake side so as to project outward from an outer periphery of the lower end of the vertical wall portion 41.

Furthermore, for example, a cold region heater insertion portion 47 may be provided as shown in FIGS. 7 and 13. The cold region heater insertion portion 47 is provided at the lower end of the vertical wall portion 41 at the second side. The cold region heater insertion portion 47 is a cutout into which a cold region heater is inserted.

Since the spacer 40 is provided inside the block-side water jacket 33, the spacer 40 is made of resin having heat resistance by which the spacer 40 can withstand high temperature in the cylinder block 3 and stiffness by which the spacer 40 does not deform or is not damaged by the pressure of the cooling water W. This resin may be one of polyamide-based thermoplastic resin (PA66, PPA, etc.), olefine-based thermoplastic resin (PP), and polyphenylene sulfide-based thermoplastic resin (PPS) or a combination of these resins. The resin may be mixed with glass fiber or the like according to need. The spacer 40 made of the resin is integrally formed by an injection molding machine.

Next, the actions of the spacer 40 will be explained in reference to FIGS. 6 to 13. These drawings show arrows indicating the flow of the cooling water W when the spacer 40 is provided inside the block-side water jacket 33.

(1) First, the cooling water W is introduced through the introducing hole 36 of the cylinder block 3 into the block-side water jacket 33 by the water pump 5.

At this time, as shown in FIGS. 3 to 5, since the spacer 40 is provided in the block-side water jacket 33 so as to be spaced apart from the inner wall portions 34*a* and 35*a* and the outer wall portions 34*b* and 35*b*, it is possible to prevent a case where the cooling water W introduced through the introducing hole 36 directly contacts the inner wall portion 35*a* of the block-side water jacket 33, and the temperature of the cylinder becomes locally low at this portion.

As shown in FIG. 7, although the cooling water W is introduced through the introducing hole 36, the flow of the cooling water W to the intake-side passage 35 is restricted by the restrictor portion 42 provided at the intake side in the vicinity of the introducing hole 36. Therefore, most of the cooling water W flows to the exhaust-side passage 34. However, since the projection amount of the lower restrictor portion 42*b* is smaller than the projection amount of the upper restrictor portion 42*a*, a relatively small amount of cooling water W flowed through the larger space between the lower restrictor portion 42*b* and outer wall portion 35*b* flows to the intake-side passage 35.

Therefore, since the amount of cooling water W flowing to the exhaust-side passage 34 is larger than the amount of cooling water W flowing to the intake-side passage 35, the cylinder block 3 at the exhaust side which tends to become higher in temperature than the intake side can be cooled down. Thus, a temperature difference between the intake side and exhaust side of each cylinder can be suppressed.

Figure 6:
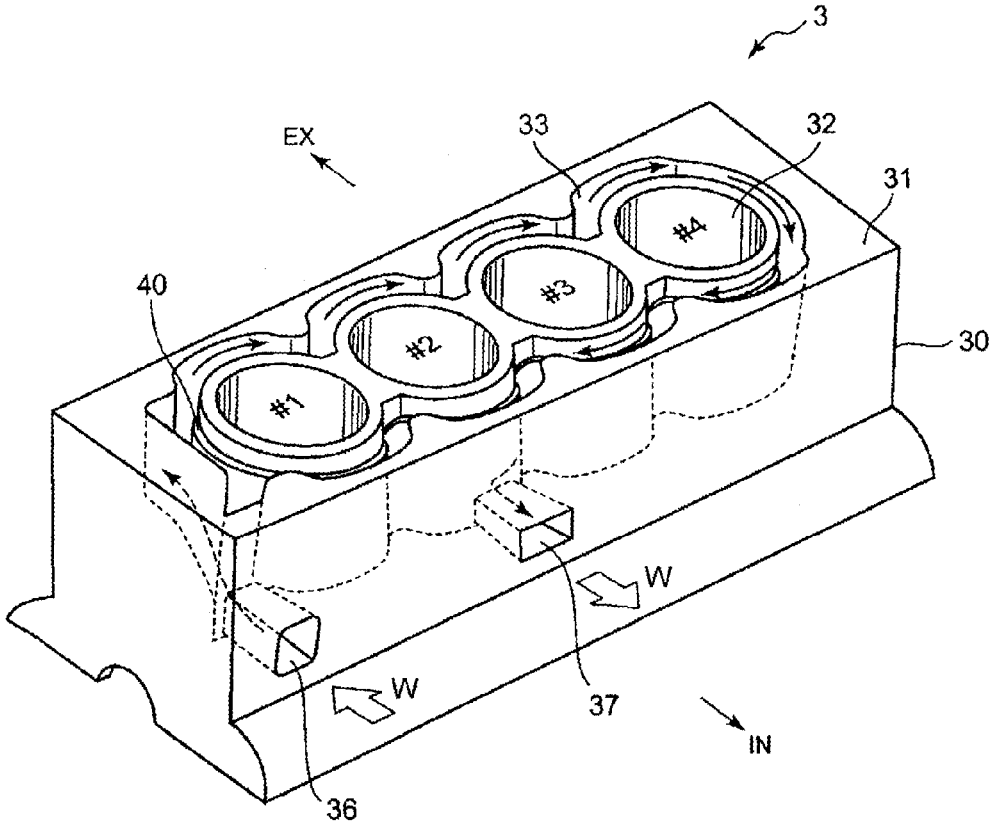
FIG. 6 is a perspective view of the cylinder block.

(2) Next, as shown in FIGS. 6, 7, and 12, the cooling water W flowing to the exhaust-side passage 34 is directed to and flows to the cylinder head 4 side by the inclined portion 43 provided at the exhaust side in the vicinity of the introducing hole 36.

The block-side water jacket 33 and the head-side water jacket 61 are connected to each other through the first communication holes 52 provided at the first side of the gasket 50. Therefore, in a case where the below-described cooling circuit control portion 101 operates such that the cooling water W circulates only in the first passage 11 when the engine is cold, the cooling water W directed to the cylinder head 4 side does not flow to the exhaust-side passage 34 of the block-side water jacket 33 but flows through the first communication holes 52 into the head-side water jacket 61.

Therefore, the cylinder block 3 is not cooled down and gradually increases in temperature. Thus, the warm up of the engine 2 is accelerated.

(3) Next, as shown in FIGS. 8 and 11, the cooling water W flowing from the inclined portion 43 to the exhaust-side passage 34 flows to the upper side of the step portion 44 by the step portion 44 which is continuous with the upper end portion of the inclined portion 43, the space between the spacer 40 and the outer wall portion 34*b* being larger at the upper side, the passage cross-sectional area of the upper side being larger, the amount of cooling water W flowing through the upper side being larger than the amount of cooling water W flowing through the lower side.

Therefore, an exhaust side upper portion of the cylinder block 3 can be cooled down more than an exhaust side lower portion of the cylinder block 3, the exhaust side upper portion being a portion which especially tends to increase in temperature due to the exhaust gas when the engine is actually operating. On this account, the temperature difference between the upper side and lower side of each cylinder can be suppressed.

(4) Next, as the cooling water W flowing through the exhaust-side passage 34 flows from the exhaust-side passage 34 toward the intake-side passage 35, the cooling water W is directed to the cylinder head side by the guide portion 45 which is continuous with the step portion 44 and provided at the second side of the vertical wall portion 41.

Therefore, the cooling water W directed to the cylinder head side tends to flow to the head-side water jacket 61 through the second communication holes 53 provided at the intake side of the gasket 50. Therefore, the cylinder head 4 can be cooled down more actively.

(5) Next, the cooling water W which did not flow to the head-side water jacket 61 through the second communication holes 53 flows through the intake-side passage 35 to be discharged through the block-side discharging hole 37 provided at a middle portion of the cylinder row at the intake side of the cylinder block 3.

While the cooling water W flows from the introducing hole 36 to the block-side discharging hole 37 as above, the cooling water W absorbs the heat of the cylinders and therefore increases in temperature. On this account, the exhaust side of the first cylinder #1 is cooled down by the cooling water W which is relatively low in temperature. However, since the cooling water W hardly flows through the intake side due to the restrictor portion 42, the intake side of the first cylinder #1 is not cooled down. The exhaust side and intake side of the fourth cylinder #4 are cooled down by the cooling water W which is relatively high in temperature.

Therefore, in the case of comparing an average of the degree of cooling of the exhaust side of one cylinder and the degree of cooling of the intake side of the one cylinder with an average of the degree of cooling of the exhaust side of the different cylinder and the degree of cooling of the intake side of the different cylinder, even the first cylinder #1 and the fourth cylinder #4 which are located at both respective ends of the cylinder row can be said to be substantially equally cooled down. On this account, the temperature difference among the cylinders is suppressed.

As above, the temperature distribution of all the cylinders can be uniformized by suppressing the temperature difference between the upper side and lower side of each cylinder, the temperature difference between the exhaust side and intake side of each cylinder, and the temperature difference among the cylinders.

(6) The flange portion 46 projecting outward from the outer periphery of the spacer 40 is provided at a lower end of an intake-side portion of the vertical wall portion 41. Therefore, the cooling water W flowing to the intake-side passage 35 through the space between the lower restrictor portion 42*b* and the outer wall portion 35*b* is prevented by the flange portion 46 from flowing from the lower end of the spacer 40 into the spacer 40. Thus, the temperature difference between the upper side and lower side of the cylinder can be prevented from increasing.

(7) Further, in a case where the cold region heater insertion portion 47 is provided at the spacer 40, the cooling water W in the block-side water jacket 33 can be prevented from freezing by inserting the cold region heater into the cold region heater insertion portion 47 of the vertical wall portion 41.

(8) Finally, since the restrictor portion 42, the inclined portion 43, the step portion 44, the guide portion 45, and the flange portion 46 are provided at the outer periphery of the vertical wall portion 41 of the spacer 40, the restrictor portion 42, the inclined portion 43, the step portion 44, the guide portion 45, and the flange portion 46 can be easily integrated with the spacer 40.

Figure 14:
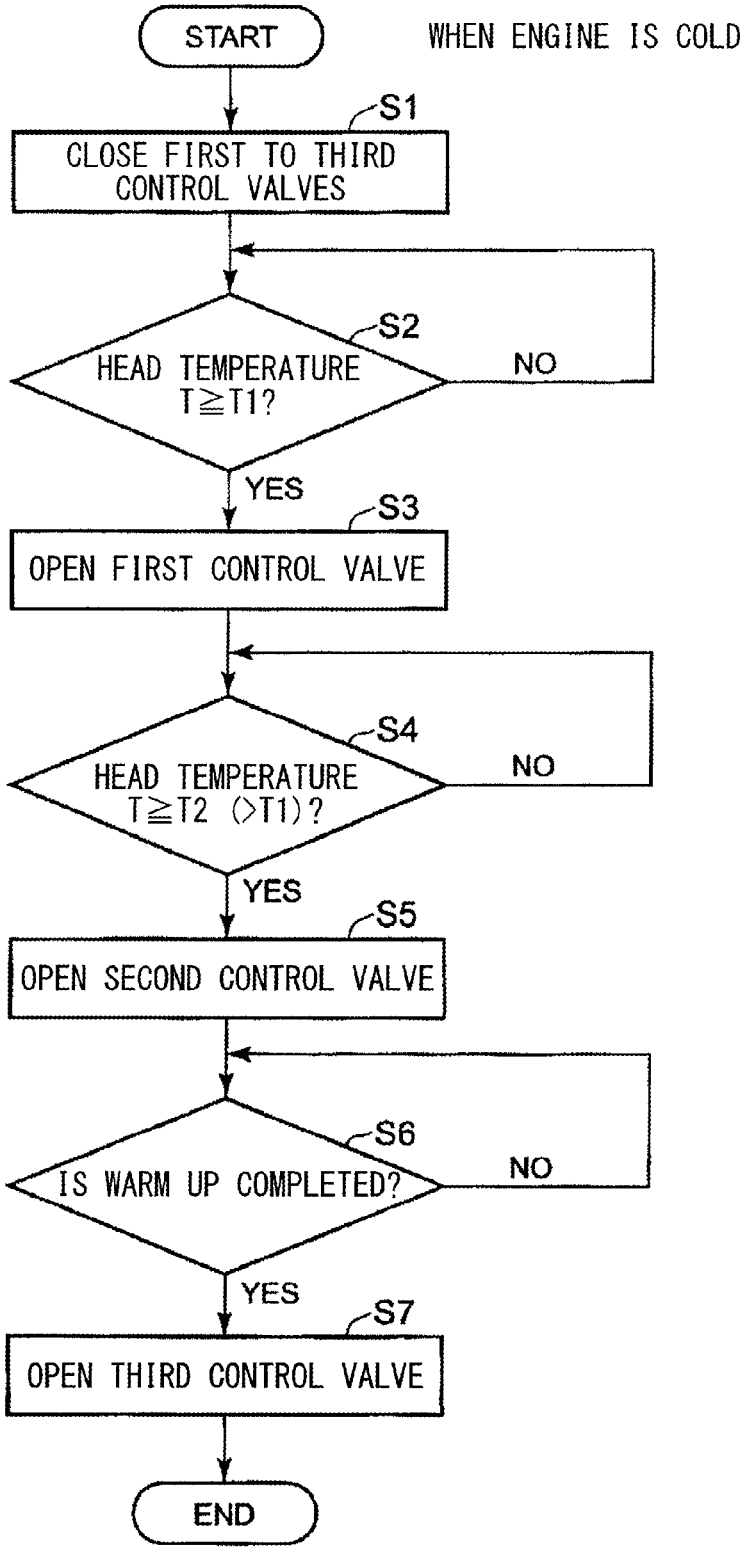
FIG. 14 is a flow chart showing a control method executed by a cooling circuit control portion of the cooling device.

FIG. 14 is a flow chart showing a control method executed by the cooling circuit control portion 101. FIGS. 15A, 15B, 15C, and 15D are block diagrams showing a cooling method executed in accordance with the temperature of the engine. Referring to FIGS. 15A, 15B, 15C, and 15D, the method of controlling the cooling device 1 by the cooling circuit control portion 101 will be explained in accordance with the flow chart of FIG. 14.

Figure 15A:
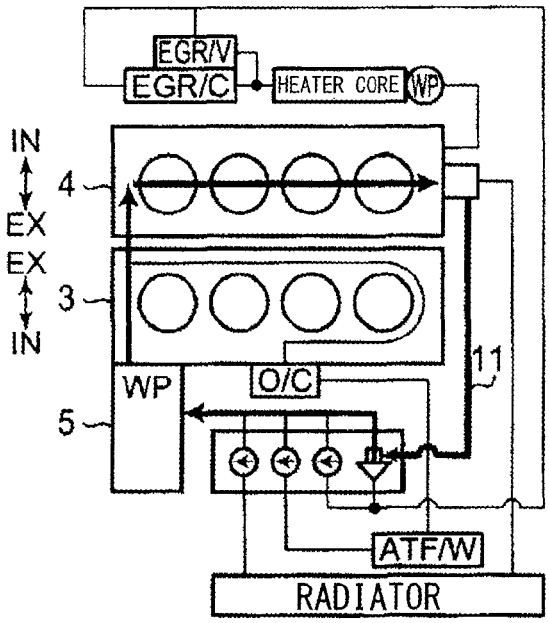
FIGS. 15A, 15B, 15C, and 15D are block diagrams showing a cooling method executed by the cooling device in accordance with a temperature of an engine.

First, when the engine is cold, all the control valves 6*b* to 6*d* are closed (Step S1). At this time, as shown in FIG. 15A, the cooling water W circulates in the first passage 11. At this time, to warm up the engine 2 while preventing local heating, a relatively small amount of cooling water W flows through the cylinder head 4.

Next, whether or not the head combustion chamber wall surface temperature T is not less than a predetermined temperature T1 (for example, 150° C.) is determined (Step S2).

Figure 15B:
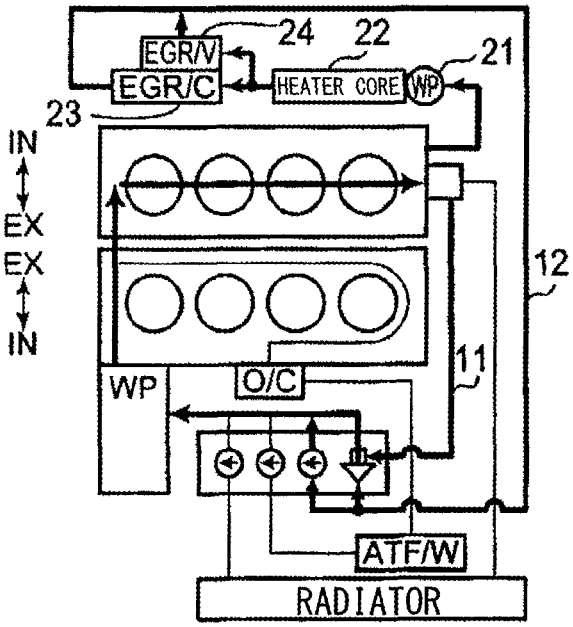

When it is determined in Step S2 that the head combustion chamber wall surface temperature T is not less than the predetermined temperature T1, the first control valve 6*b* is opened (Step S3). At this time, as shown in FIG. 15B, the cooling water W circulates in the first passage 11 and the second passage 12.

Next, whether or not the head combustion chamber wall surface temperature T is not less than a predetermined temperature T2 (T2>T1) is determined (Step S4).

Figure 15C:
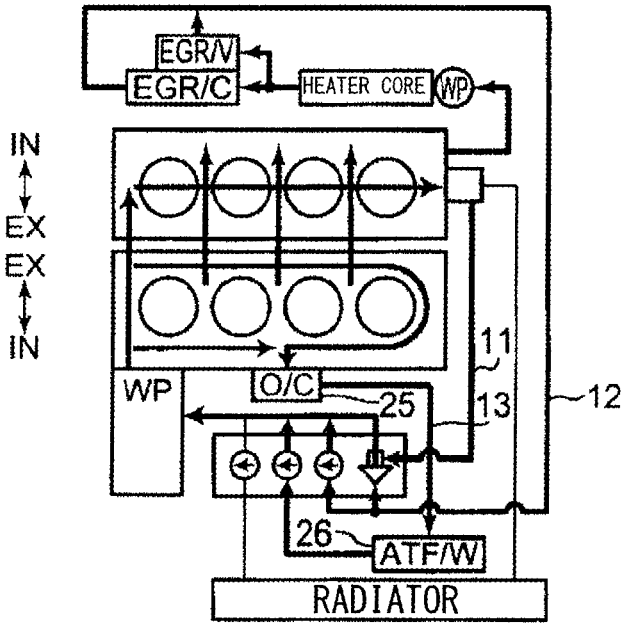

When it is determined in Step S4 that the head combustion chamber wall surface temperature T is not less than the predetermined temperature T2, the second control valve 6*c* is opened (Step S5). At this time, as shown in FIG. 15C, the cooling water W circulates in the first to third passages 11 to 13.

Next, whether or not the warm up of the engine 2 is completed is determined (Step S6). This determination may be made by determining whether or not the head combustion chamber wall surface temperature T is not less than a predetermined temperature T3 (T3>T2).

Figure 15D:
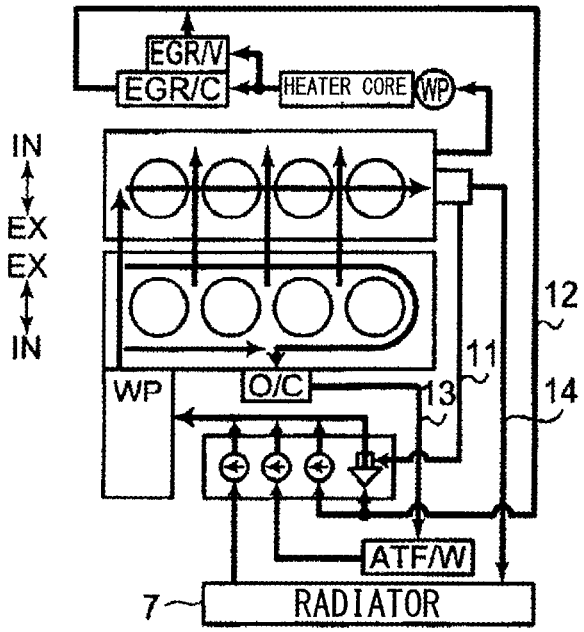

Finally, when it is determined in Step S6 that the warm up of the engine 2 is completed, the third control valve 6*d* is opened (Step S7). At this time, as shown in FIG. 15D, the cooling water W circulates in all of the first to fourth passages 11 to 14.

As above, when the first to third control valves 6*b* to 6*d* are closed by the cooling circuit control portion 101 during the warm up, the cooling water W circulates only in the first passage 11 connecting the head-side discharging hole 62 and the introducing hole 36 with each other. At this time, the cooling water W hardly flows to the block-side water jacket 33. Therefore, the temperature of the cylinder block 3 gradually increases. On this account, the warm up of the engine 2 can be accelerated.

The first to third control valves 6*b* to 6*d* are sequentially opened by the cooling circuit control portion 101 in accordance with the increase in the temperature of the engine. At this time, when the first control valve 6*b* is opened, the cooling water W circulates also in the second passage 12. However, the second passage 12 does not extend through the radiator 7, and the cooling water W hardly flows to the block-side water jacket 33. Therefore, the warm up of the engine 2 is continuously accelerated.

Next, when the second control valve 6*c* is opened, the cooling water W circulates also in the third passage 13. Since the third passage 13 is connected to the cylinder block 3, the cylinder block 3 is also cooled down to some extent. However, since the third passage 13 bypasses the radiator 7, the warm up of the engine 2 progresses.

Further, when the third control valve 6*d* is opened, the cooling water W circulates also in the fourth passage 14. Since the fourth passage 14 is connected to the radiator 7, the temperature of the cooling water W is decreased by the radiator 7. Thus, the engine 2 can be maintained at a predetermined temperature after the warm up.

As above, the cooling circuit control portion 101 closes the first to third control valves 6*b* to 6*d* during the warm up and sequentially opens the first to third control valves 6*b* to 6*d* in accordance with the increase in the temperature of the engine. With this, the cylinders and the cylinder head 4 can be properly cooled down in accordance with the temperature of the engine 2.

The first control valve 6*b* is opened in the middle of the warm up, and the cooling water W also circulates in the second passage 12 extending through the air conditioner heater core 22 or the EGR cooler 23. Therefore, a heating performance can be secured from the middle of the warm up, and the EGR cooler 23 can be properly cooled down.

Further, the third control valve 6*d* is opened in the middle of the warm up, and the cooling water W circulates also in the third passage 13 extending through the engine oil cooler 25 or the oil heat exchanger 26 of the automatic transmission. Therefore, engine oil can be cooled down. In addition, transmission oil is properly heated, so that the sliding resistance is quickly decreased by quickly decreasing the viscosity of the transmission oil. Thus, the fuel efficiency can be improved.

The present invention is not limited to the embodiment described above. Needless to say, various modifications and design changes may be made within the scope of the present invention.

For example, in the present embodiment, the restrictor portion 42, the inclined portion 43, and the step portion 44 are formed integrally with the spacer 40. However, the spacer 40 may not be provided, and the cylinder block 3 itself may have the restrictor portion 42, the inclined portion 43, and the step portion 44 by devising an internal shape of the block-side water jacket 33 such that the block-side water jacket 33 has the functions of the restrictor portion 42, the inclined portion 43, and the step portion 44.

The present embodiment is applied to the in-line four-cylinder diesel engine. However, the number of cylinders may be any number as long as it is plural. In addition, the present invention is not limited to the diesel engine. Therefore, the present invention may be applied to a gasoline engine.

INDUSTRIAL APPLICABILITY

As above, according to the present invention, all cylinders in a multiple cylinder engine of a car or the like can be uniformly cooled down. Therefore, the present invention is suitably utilized in an industrial manufacturing field of this type of engine.

REFERENCE CHARACTER LIST

1 cooling device
2 multiple cylinder engine

3 cylinder block
4 cylinder head
water pump
6*b* first control valve
6*c* second control valve
6*d* third control valve
7 radiator
11 first passage
12 second passage
13 third passage
14 fourth passage
22 air conditioner heater core
23 EGR cooler
25 engine oil cooler
26 oil heat exchanger of automatic transmission
30 cylinder block main body (cylinder block)
32 cylinder bore
33 block-side water jacket (water jacket of cylinder block)
34 exhaust-side passage (exhaust-side portion of water jacket)
35 intake-side passage (intake-side portion of water jacket)
34*a*, 35*a* inner wall portion
34*b*, 35*b* outer wall portion
36 introducing hole (introducing portion)
37 block-side discharging hole (discharging portion of cylinder block)
40 spacer
42 restrictor portion
42*a* upper restrictor portion
42*b* lower restrictor portion
52 first communication hole (communication passage)
61 head-side water jacket (water jacket of cylinder head)
62 head-side discharging hole (discharging portion of cylinder head)
101 cooling circuit control portion
W cooling water (cooling liquid)
#1 to #4 cylinder

The invention claimed is:

1. A cooling device for a multiple cylinder engine, the cooling device comprising:

a water jacket provided at a cylinder block so as to surround cylinder bores of a plurality of cylinders arranged in series;

a water jacket provided at a cylinder head; and a cooling liquid passage in which a cooling liquid circulates by a water pump, the cooling liquid passage extending through these water jackets and a radiator, wherein:

the water jacket provided at the cylinder block includes:

an exhaust-side passage extending through an exhaust side of the cylinder block, and an intake-side passage extending through an intake side of the cylinder block;

the cylinder block includes:

an introducing portion provided at one cylinder row direction end portion of the cylinder block, the cooling liquid being introduced through the introducing portion to the water jacket of the cylinder block, a restrictor portion provided in the water jacket of the cylinder block and being adjacent to and located immediately downstream of the introducing portion in a flow direction, the restrictor portion being configured to restrict the cooling liquid, introduced through the introducing portion, from flowing to the intake-side passage and promote the flow of the cooling liquid to the exhaust-side passage, and a discharging portion through which the cooling liquid is discharged from the water jacket of the cylinder block; and the exhaust-side passage is formed such that the cooling liquid flowing into the exhaust-side passage flows through both cylinder axis direction upper and lower sides of the exhaust-side passage, and a passage cross-sectional area of the cylinder axis direction upper side of the exhaust-side passage is larger than a passage cross-sectional area of the cylinder axis direction lower side of the exhaust-side passage.

2. The cooling device according to claim 1, wherein:

a spacer is provided inside the water jacket of the cylinder block so as to be spaced apart from an inner wall portion and an outer wall portion of the water jacket of the cylinder block;

the restrictor portion is formed at an outer periphery of the spacer; and a portion of the spacer which corresponds to the exhaust-side passage is formed such that a space between the spacer and the outer wall portion at a cylinder axis direction upper side of the portion of the spacer is larger than a space between the spacer and the outer wall portion at a cylinder axis direction lower side of the portion of the spacer.

3. The cooling device according to claim 1, wherein:

the cylinder head includes a discharging portion provided at a second side of the cylinder row, the cooling liquid being discharged from the water jacket of the cylinder head through the discharging portion;

the water jacket of the cylinder block and the water jacket of the cylinder head are connected to each other through a communication passage; and the cooling liquid passage includes:

a first passage bypassing the radiator and coupling the discharging portion of the cylinder head to the introducing portion, a second passage bypassing the radiator and coupling the discharging portion of the cylinder head to the introducing portion through a first control valve configured to control a first flow rate of the cooling liquid, a third passage bypassing the radiator and coupling the discharging portion of the cylinder block to the introducing portion through a second control valve configured to control a second flow rate of the cooling liquid, and a fourth passage coupling the discharging portion of the cylinder head to the introducing portion through the radiator and a third control valve configured to control a third flow rate of the cooling liquid, the cooling device further comprising a cooling circuit control portion configured to close the first to third control valves during warm up and sequentially open the first to third control valves as a temperature of the engine increases.

4. The cooling device according to claim 3, wherein the second passage extends through at least one of an air conditioner heater core and an EGR cooler.

5. The cooling device according to claim 3, wherein the third passage extends through at least one of an engine oil cooler and an oil heat exchanger of an automatic transmission.

6. The cooling device according to claim 2, wherein:

the cylinder head includes a discharging portion provided at a second side of the cylinder row, the cooling liquid being discharged from the water jacket of the cylinder head through the discharging portion;

the water jacket of the cylinder block and the water jacket of the cylinder head are connected to each other through a communication passage; and the cooling liquid passage includes:

a first passage bypassing the radiator and coupling the discharging portion of the cylinder head to the introducing portion, a second passage bypassing the radiator and coupling the discharging portion of the cylinder head to the introducing portion through a first control valve configured to control a first flow rate of the cooling liquid, a third passage bypassing the radiator and coupling the discharging portion of the cylinder block to the introducing portion through a second control valve configured to control a second flow rate of the cooling liquid, and a fourth passage coupling the discharging portion of the cylinder head to the introducing portion through the radiator and a third control valve configured to control a third flow rate of the cooling liquid, the cooling device further comprising a cooling circuit control portion configured to close the first to third control valves during warm up and sequentially open the first to third control valves as a temperature of the engine increases.

7. The cooling device according to claim 6, wherein the second passage extends through at least one of an air conditioner heater core and an EGR cooler.

8. The cooling device according to claim 6, wherein the third passage extends through at least one of an engine oil cooler and an oil heat exchanger of an automatic transmission.

9. The cooling device according to claim 1, wherein a cross-sectional area of the intake-side passage is larger than a cross-sectional area of the exhaust-side passage.

10. The cooling device according to claim 1, wherein the introducing portion is formed on an intake-side wall surface of the cylinder block and introduces the cooling liquid in a direction toward the exhaust side of the cylinder block.

11. The cooling device according to claim 1, wherein the discharging portion is provided at a cylinder row direction middle portion of the intake side of the cylinder block.

* * * * *